US005405022A

United States Patent [19]

Rissley

[11] Patent Number: 5,405,022

[45] Date of Patent: Apr. 11, 1995

[54] DISPLAY STRIP AND PRODUCT SUPPORT COMBINATION

[75] Inventor: Stewart R. Rissley, Bangor, Mich.

[73] Assignee: Do-It Corporation, South Haven, Mich.

[21] Appl. No.: 132,130

[22] Filed: Oct. 5, 1993

[51] Int. Cl.[6] ..... B42F 15/00

[52] U.S. Cl. ..... 211/59.1; 206/461; 206/806; 211/71; 211/113; 248/205.3

[58] Field of Search ..... 248/223.4, 222.2, 221.3, 248/221.4, 205.3, 220.2, 224.4, 225.1; 40/617; 211/59.1, 71, 113; 206/806, 461, 482

[56] References Cited

U.S. PATENT DOCUMENTS

| | | | |
|---|---|---|---|
| 4,334,611 | 6/1982 | Watson et al. | 206/482 X |
| 4,483,502 | 11/1984 | Fast | 248/220.2 X |
| 4,718,627 | 1/1988 | Fast et al. | 248/223.4 X |
| 5,103,970 | 4/1992 | Nielson et al. | 206/482 X |
| 5,284,259 | 2/1994 | Conway et al. | 248/225.1 X |

*Primary Examiner*—Ramon O. Ramirez
*Attorney, Agent, or Firm*—Flynn, Thiel, Boutell & Tanis

[57] ABSTRACT

A display strip and product support combination for mounting a product for display is provided in the form of a first strip of flexible material having a hanging section and a supporting section, the hanging section being positioned above the supporting section and comprising a means for hanging the first strip. The supporting section comprises a support member or first tongue defined by cut lines and a bend area in the supporting section. A second material has provided therein die cut lines and a second bend area defining a flap member or second tongue. Each of the support members and flap members are complimentary in shape and size such that the first strip is lockingly engageable to the second material. Alternatively, either the support member or the flap member may be replaced by a circular aperture or hole that is complimentary in shape and size to the remaining tongue for locking engagement of the two strips.

30 Claims, 4 Drawing Sheets

PRIOR DISPLAY STRIP

DISPLAY STRIP AND PRODUCT SUPPORT COMBINATION

FIELD OF THE INVENTION

This invention relates to a display strip and hang tab for hanging display products on a support structure, such as a peg or hook, provided on a merchandise supporting display shelf or wall.

BACKGROUND OF THE INVENTION

It is known to display products for sale such as blister packs, video cassettes and the like by attaching them to flat plastic hangers which have an adhesive portion that bonds to the product and a hanging means, such as an aperture, by which the hanger and the product are supported by a support structure, such as a peg or a hook.

For example, U.S. Pat. No. 4,718,627, discloses a strip of plastic having an elongate body portion provided with a series of superimposed slits, each in the form of an elongated W and each defining a central upwardly extending product suspension hook or finger and outer stabilizing fingers. The suspension hook or finger is available for mounting display items for sale such as a blister pack-having a mounting aperture in the wrapping or an adhesively bound mounting strip having an aperture therein. The body portion of the strip is mounted on the forward edge of a merchandise display shelf to display items for sale in a manner which is more visible and more easily accessible to the shopper.

The display strip of U.S. Pat. No. 4,718,627 and similar display strips have the advantage that they can be easily mounted on the forward portion of the merchandise display shelf and products can be quickly and easily mounted thereon. However, these type of hangers with non-locking fingers or hooks have the disadvantage that products mounted thereon are easily dislodged. Another disadvantage of these types of hangers is that products must be loaded manually. It is very difficult to load products on these display strips automatically because three fingers must be moved to mount a single product.

Therefore, there is a need to provide a display strip and hang tab combination that can be mounted so as to extend perpendicular to a horizontal merchandise support surface or can be mounted parallel to a vertical surface such as a wall or panel wherein products can be securely mounted and still be easily accessible and detachable by a purchaser or user. There is also a need to provide a display strip and hang tab combination that can be automatically loaded with products.

Additionally, there is a need to also provide a die cut chipboard or cardboard backer for a blister pack package or a boxed package shrink wrapped onto the backer, or even the box itself, with the same type of support configuration provided on a hang tab so that the display strip can be used in conjunction therewith independent of a hang tab.

SUMMARY OF THE INVENTION

The objects and purposes of the present invention are met by providing a display strip and hang tab combination for hanging a product. The display strip and hang tab combination comprises a first strip of flexible material and a second strip of flexible material that cooperate together to hang a product that is attachable to the second strip. The first strip of flexible material has a hanging section and a supporting section. The hanging section is positioned above the supporting section and comprises a means for facilitating a hanging first strip. The supporting section comprises a support member or first tongue defined by cut lines and a bend area in the supporting section.

The support member comprises a widest most width and a narrowest most width below the widest most width. The support member is pivotable between an initial position wherein the support member lies in a plane containing the supporting section and a second position wherein the support member projects from the bend area out of the plane containing the supporting section and creates an opening therein.

The second strip of flexible material comprises a first portion and a second portion. The first portion has a bonding section to which a product can be attached. The second portion has provided therein cut lines and a second bend area defining a flap member or second tongue. The flap member comprises a widest most width and a narrowest most width below the widest most width and is pivotable between an initial position wherein the flap member lies in a plane containing the second portion and a second position wherein the flap member projects from the second bend area out of the plane containing the second portion and creates an opening therein.

The support member of the first strip is complimentary in shape and size with the flap member or second tongue of the second strip such that the first strip is lockingly engaged to the second strip by either (1) insertion of a support member or first tongue deformed into an opening created in the second portion of the second strip whereby the second portion opposes the removal of the support member undeformed or (2) insertion of a flap member into an opening created in the supporting section whereby the supporting section opposes the removal of a flap member undeformed. Alternatively, one of the tongues (support member or flap member) may be replaced by an aperture or hole that is complimentary in size and shape to the remaining tongue for locking engagement of the remaining tongue. This display strip and hang tab combination permits products to be securely mounted thereon and still be easily accessible and detachable. The purchaser or user simply pulls on the product to detach the hang tab from the display strip.

A further alternative is to provide the same connective features that are present on the aforementioned hang tab on a chipboard or cardboard backer for a blister pack package or a shrink wrapped box on a backer or even the box itself so that the display strip can be used in conjunction therewith and independent of the provision of a hang tab.

BRIEF DESCRIPTION OF THE DRAWINGS

Referring to the attached drawings.

DETAILED DESCRIPTION

Figure 1:
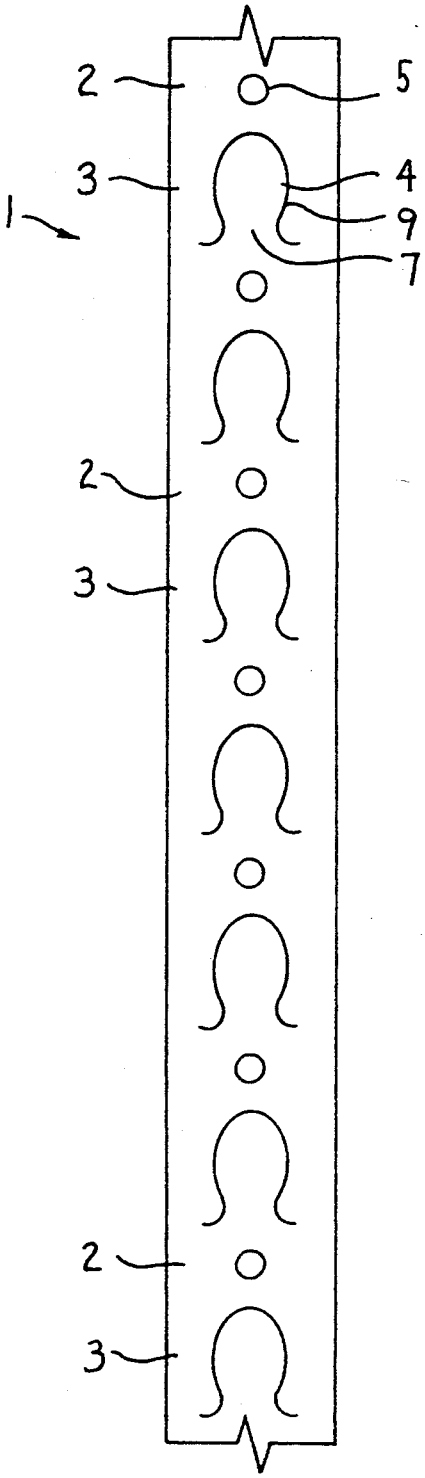
FIG. 1 is a plan view of a display strip according to the invention.

Referring to FIG. 1, there is shown a display strip, referred to herein as a first strip 1, according to the invention, which is flat and made of a uniformly thick thermoplastic material and which is adapted to support a product having a hang tab mounted thereon. The material of the first strip 1 has a thickness of about 0.010 to 0.025 inches. The first strip 1 comprises an alternating pattern of hanging sections 2 and supporting sections 3, each hanging section being positioned between the next adjacent upper and lower supporting sections. The hanging sections each comprise a means for facilitating a hanging 5 of the first strip 1. Normally, the means for facilitating a hanging 5 can be any type of aperture in the hanging section or may be any other suitable means for facilitating a hanging, such as an adhesive on the back side of the hanging section.

Each supporting section 3 has a support member 4 in the form of a first tongue which is defined by cut lines 9 and a base or bend area 7. The support member or first tongue 4 is positioned generally midway between the lateral edges of the first strip 1. The cut lines 9 extend all the way through the first strip 1 so that the support member or first tongue 4 can be flexed outward from the plane of the first strip 1 about the bend area 7.

Figure 2A:
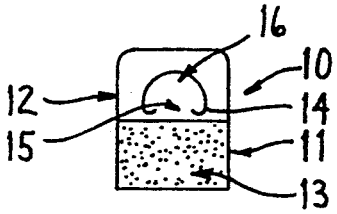
FIG. 2A is a plan view of a hang tab according to the invention having a tongue.
Figure 2B:
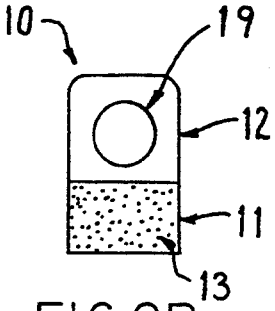
FIG. 2B is a plan view of a hang tab according to the invention defining a circular aperture.

Referring to FIGS. 2A and 2B, there is shown a hang tab, referred to herein as a second strip 10 divided into a first portion 11 and a second portion 12. The second strip 10 is flat and made of a uniformly thick thermoplastic material that is preferably slightly thinner than the material of the first strip 1, such as about 0.005 to 0.025 inches. Alternatively, the second strip may be of the same thickness as the first strip. The first portion 11 has a bonding section 13 which preferably is a coating of a suitable adhesive for facilitating a bonding of the second strip 10 to a product to be mounted thereon. The second portion 12 is located above the first portion 11. The second portion 12 has provided therein cut lines 14 and a second base or bend area 15 defining a flap member or second tongue 16 as shown in FIG. 2A. The flap member or second tongue 16 is positioned generally midway between the lateral edges of the second strip 10. The cut lines 14 extend all the way through the second portion 12 so that the flap member or second tongue 16 can be flexed outward from the plane of the second strip 10 about the bend area 15.

Alternatively, the second portion 12 may have provided therein cut lines defining a circular aperture or hole 19 as shown in FIG. 2B.

Figure 3:
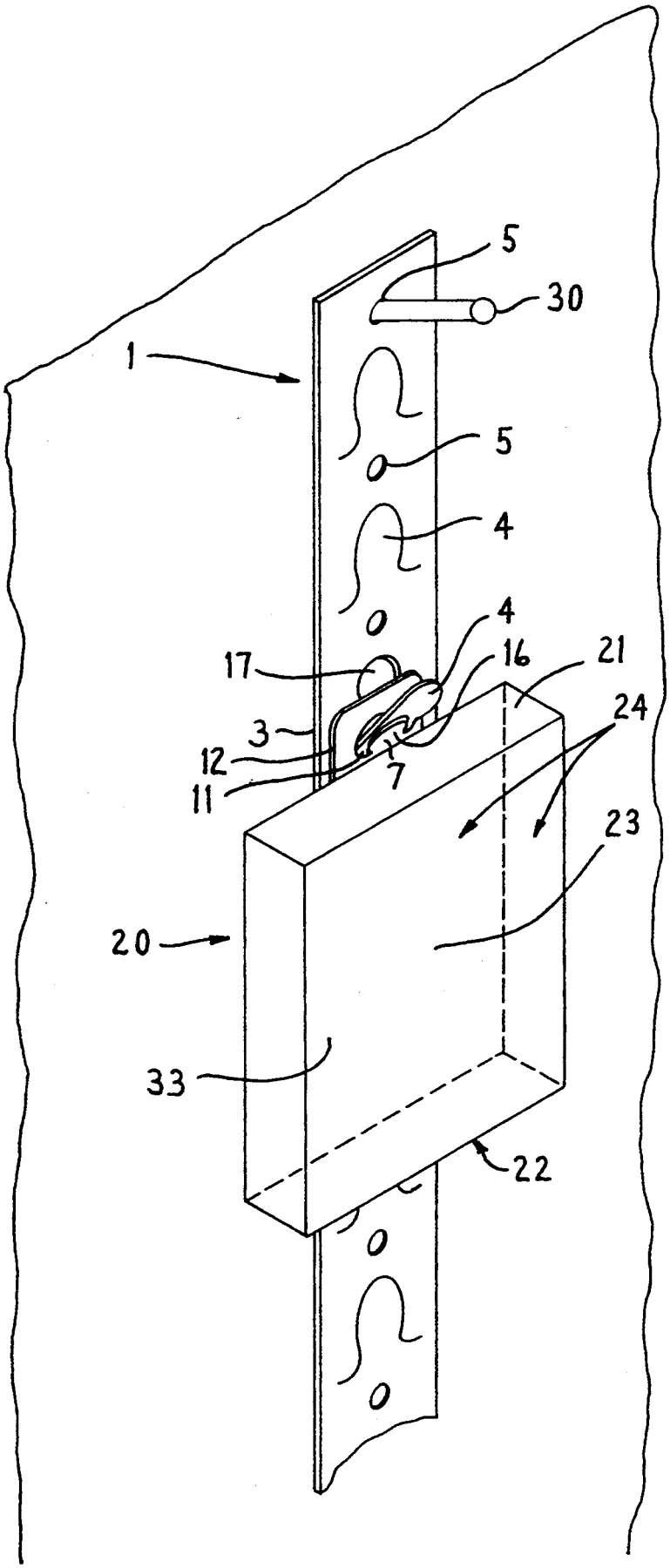
FIG. 3 is an isometric view of a hang tab mounted on a display strip showing a state in which a product is bonded to the hang tab.

A typical product 20 (FIG. 3) usually comprises a top wall 21, a bottom wall 22 and four longitudinally extending side walls 24 joining the top and bottom walls. The product also has a center of gravity 23. Referring to FIG. 3, there is shown the product 20 bonded to the second strip 10 and mounted on the first strip 1. Further, the first strip 1 is mounted on a wall mounted peg 30 which is inserted through the means for facilitating a hanging 5, namely, the aperture. According to the first embodiment of the invention, the support member or first tongue 4 is bent about the bend area 7 so as to project away from the plane of the supporting section 3 to create an opening 17 in the supporting section 3. The product 20 having the second strip 10 attached thereto is mounted on the first strip 1 by first inserting the support member or first tongue 4 through an opening 18 created in the second portion 12 when the flap member 16 is pressed by the first tongue 4 out of the plane of the second strip 10. The support member or first tongue 4 is wider at its widest most width than the widest most width of flap member or second tongue 16 and wider than the widest width of the opening 18 in the second portion 12 and thus must be deformed into somewhat of a shallow U-shaped bend as shown in FIG. 6A to permit its insertion through the opening 18. The elasticity of the thermoplastic material that the second strip 10 is made out of causes the flap member or second tongue 16 to press against the support member or first tongue 4 thereby opposing the removal of the support member 4. In addition, the size and shape of the opening 18 opposes the removal of the support member 4 because the widest most part 41 of the support member 4 is greater than the widest most part of the opening 18. Thus, the product becomes suspended by a locking feature extant between the first strip and the second strip. The center of gravity 23 of the product suspends generally below the hang tab and is oriented generally midway between lateral edges of the second strip (hang tab) and lateral edges of the first strip (display strip). Other typical products that second strips 10 may be bonded to include bags, bottles and other odd shaped products having a bondable surface. Products with second strips 10 bonded thereto may be loaded manually or automatically on to the display strip by appropriate machinery not shown and not forming a part of this invention.

Figure 4:
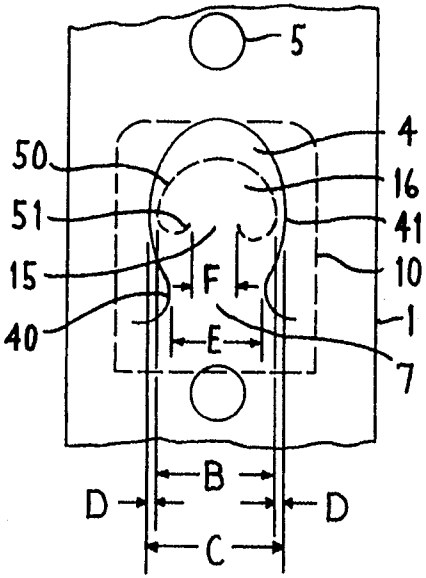
FIG. 4 is a plan view of a first embodiment of the display strip and hang tab combination according to the invention and showing the dimensional relationship between the support member of the display strip and the flap member of the hang tab.

FIG. 4 illustrates the dimensional relationships of the first strip 1 relative to the second strip 10 and, particularly, the dimensional relationship of the support member or first tongue 4 to the flap member or second tongue 16. FIG. 4 shows that the widest most part 41 of the support member or first tongue 4 has a width C. The base of the first tongue adjacent the bend 7 has a narrowest most part 40 having a narrowest most width E. The flap member or second tongue 16 has a widest most part 50 having a widest most width B. The base of the second tongue adjacent the bend 15 has a narrowest most part 51 having a narrowest most width F. The support member or first tongue 4 has a wider widest most part 41 than the widest most part 50 of flap member or second tongue 16, the difference in widths represented by the dimensions D. FIG. 4 also shows that the narrowest most part 40 of the support member or first tongue 4 is below the widest most part 41 thereof. The dimension B–E is sufficient to allow a tight fit of the first tongue 4 in the opening 18 of the second strip 10. Since the dimension B is less than the dimension C, the flap member or second tongue 16 and the opening 18 in the second strip 10 oppose removal of the support member or first tongue 4 from the second strip 10 to create the aforesaid locking feature between the support member 4 and the second portion 12 of the second strip 10.

Figure 5:
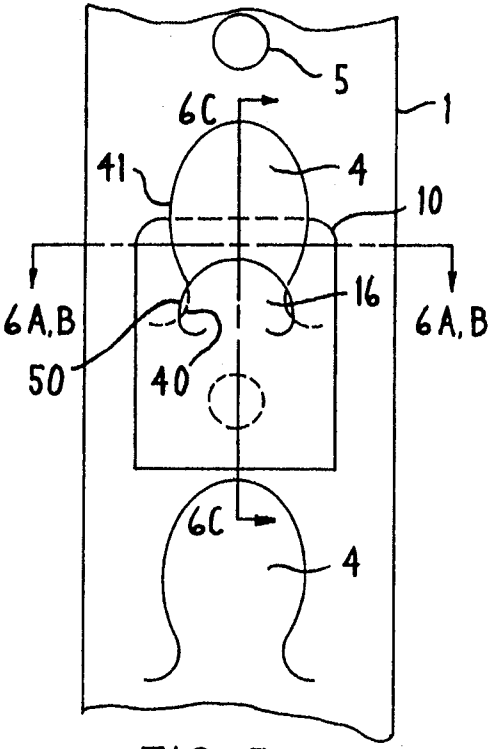
FIG. 5 is a plan view showing the first embodiment of the display strip and hang tab combination according to the invention with the hang tab mounted on the display strip.

As shown in FIG. 5, the support member or first tongue 4 is inserted through the opening 18 second strip 10. To be noted again is that the widest most part 41 of the first tongue is slightly greater than the widest most part 50 of the opening 18. This arrangement promotes the locking engagement of the support member or first tongue 4 by the second strip 10 because the edge portion of the opening 18 opposes the removal of the support member or first tongue 4 from the opening 18.

FIG. 6A shows the initial stage of effecting an interlock between the first and second strips. That is, the support member or first tongue 4 is deformed into the aforesaid slight U-shape for the purpose of facilitating insertion into the opening 18 in the second portion 12 of first strip 10. That is, the first tongue 4 is slightly curved and pressed against the second tongue 16 to thereby force the second tongue 16 to bend outward from the plane of the second strip 10 about its second bend area 15. One opening 17 is created in the supporting section 3 of the first strip 1 whereas the aforesaid opening 18 is created in the second portion 12 of the second strip 10. The support member 4 is urged out of the plane of the supporting section 3 and through the plane of the second portion 12 and the opening 18 in the second portion, consequently the flap member 16 is forced out of the plane of the second portion 12 by pressure exerted by the support member 4 in the same direction to which the support member is directed.

Figure 6C:
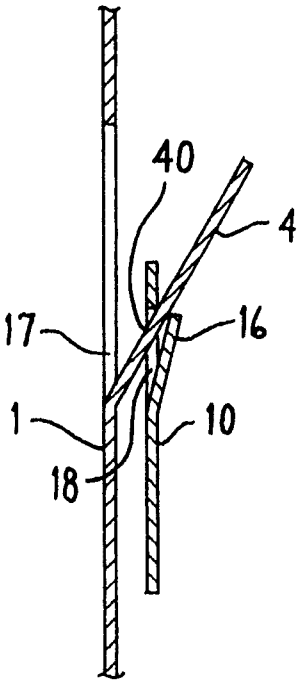
FIG. 6C is a sectional view of the combination taken along line 6C—6C in FIG. 5 showing the hang tab mounted on the display strip.
Figure 6A:
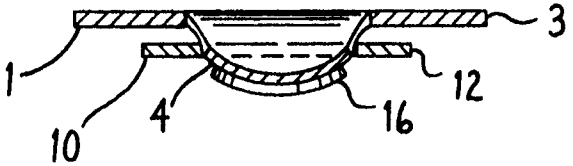
FIG. 6A is a sectional view of the combination taken along the line 6A,B—6A,B in FIG. 5 and showing a support member deformed being inserted through an opening in the second portion of the second strip.
Figure 6B:
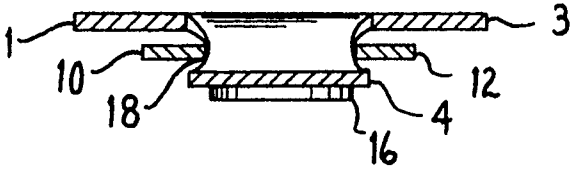
FIG. 6B is a sectional view of the combination taken along the line 6A,B—6A,B of FIG. 5 and showing a support member undeformed lockingly engaged by the second portion of the second strip.

FIG. 6B illustrates that after the support member 4 is fully inserted through the opening 18 created in the second portion 12 of the second strip 10, it returns to its uncurved, undeformed shape, the elasticity of the material having caused it to return to a generally flat condition.

FIG. 6C illustrates a second strip 10 mounted on a first strip 1. The support member or first tongue 4 of the first strip 1 is inserted through the opening 18 in the second strip 10 by pressing the support member or first tongue 4 against the flap member or second tongue 16 such that the support member extends through and beyond the plane of the second strip 10. The flap member or second tongue 16 also extends beyond the plane of the second strip 10 when the second strip 10 is mounted on the first strip 1. In this embodiment, the second strip 10 hangs in a downward direction from the area of the narrowest most part 40 of the support member or first tongue 4. A product attached to the second strip 10 would also hang in a downward direction below the support member 4 with its center of gravity oriented generally between lateral edges of the second strip 10.

The support member 4 is now lockingly engaged between the second portion 12 and the flap member 16 of the second strip 10. Because the widest dimension B of the opening 18 in the second portion 12 is of a narrower width than the widest most width C of the support member 4, the second portion 12 opposes the removal of the support member 4.

Figure 7B:
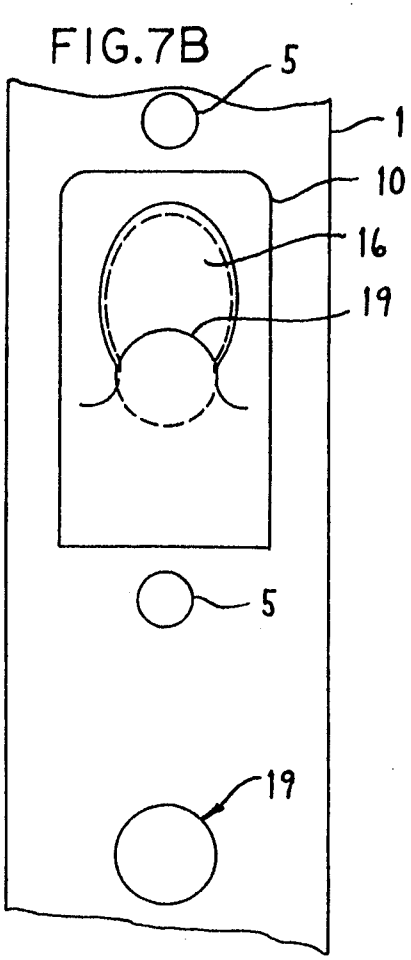
FIG. 7B is a plan view showing the display strip and hang tab combination according to the invention with the hang tab mounted on a display strip that defines circular apertures.
Figure 7A:
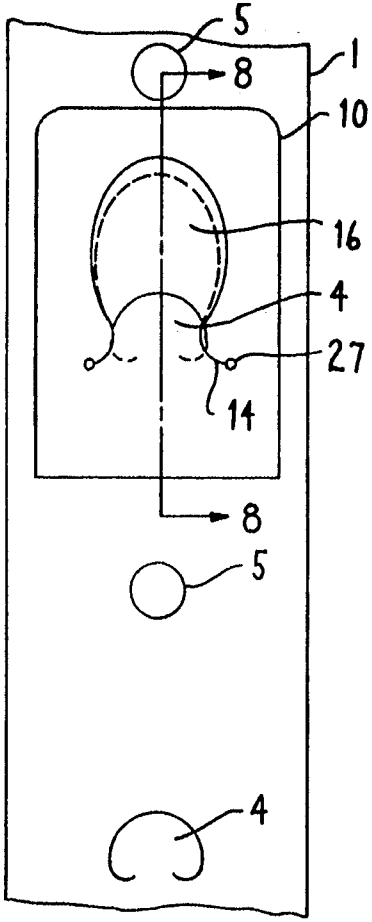
FIG. 7A is a plan view showing a second embodiment of the display strip and hang tab combination according to the invention with the hang tab having a tongue mounted on the display strip having tongues.

Referring to FIG. 7A, there is shown a second embodiment of the present invention wherein the support member or first tongue 4 is smaller than the flap member or second tongue 16. The flap member or second tongue 16 is shown in dotted lines behind the first strip 1. The flap member 16 is lockingly engaged by the first strip 1 by insertion of the flap member 16 through the first strip 1 by pressing against the support member 4 and creating an opening 17 (shown in FIG. 8) in the first strip which is narrower in width than the widest most width of the flap member 16. End holes 27 at the end of cut lines 14 prevent tearing of the second strip 10. Similar end holes may be placed at the end of cut lines 9 to prevent tearing of the first strip 1. As an alternative to end holes, cut lines 9 and 14 may also terminate in a partial non overlapping loop which also reduces tearing of the respective strips.

Alternatively, the first strip 1 may have cut lines defining therein circular apertures or holes 19 having a widest most width less than the widest most width of the flap member or second tongue 16 through which the second tongue 16 may be inserted and lockingly engaged as shown in FIG. 7B. The widest most width of the cut lines defining the hole 19 is less than the widest most width of the second tongue 16 so that the first strip 1 opposes the removal of the second tongue 16 and engages the second strip 10 with the first strip 1.

Figure 8:
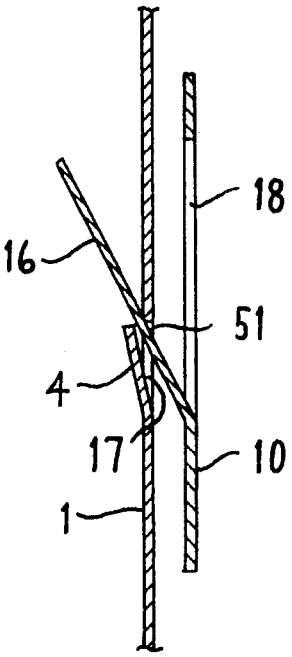
FIG. 8 is a sectional view of the combination taken along the line 8—8 in FIG. 7 showing the hang tab mounted on the display strip.

In the second embodiment, and referencing FIG. 8, the flap member or second tongue 16 extends behind the plane of the first strip 1 while the remaining part of the second strip 10 remains in front of the plane of the first strip 1. Because the flap member or second tongue 16 of the second strip 10 is lockingly engaged by the first strip 1 and extends behind the first strip 1, the second strip 10 hangs generally downwardly from its flap member 16 or second tongue 16, and the location of the narrowest most part 51 of the flap member or second tongue 16. A product attached to the second strip 10 would also hang generally downwardly from and below the flap member 16 with its center of gravity oriented generally between lateral edges of the second strip 10.

Figure 2C:
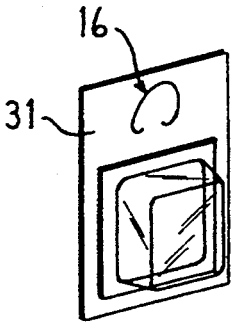
FIG. 2C is an isometric view of a blister pack package having a die cut tongue in the backer according to the invention.
Figure 2D:
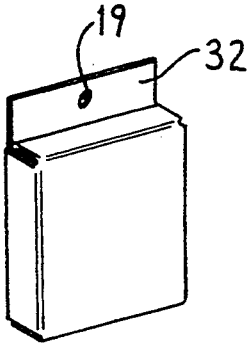
FIG. 2D is an isometric view of a box having a tab or flap with a circular aperture die cut therein according to the invention.

The invention described above can also be applied directly to the package without resorting to a use of the hang tab. That is, and referring to FIGS. 2C and 2D, chipboard or cardboard 31 (FIG. 2C) or a portion 32 (FIG. 2D) of the box itself and serves as a backer. In both instances, the die cut structure 16 and 19 described above on the hang tabs 10 shown in FIGS. 2A and 2B are applied directly to the board backers 31 or 32. Similarly, the die cut structures 16 and 19 can be applied directly to a wall of a box, such as a side panel 33 (or the verso side panel) of the box 20 shown in FIG. 3. In this instance, the hang tab would also not be required.

Figure 9:
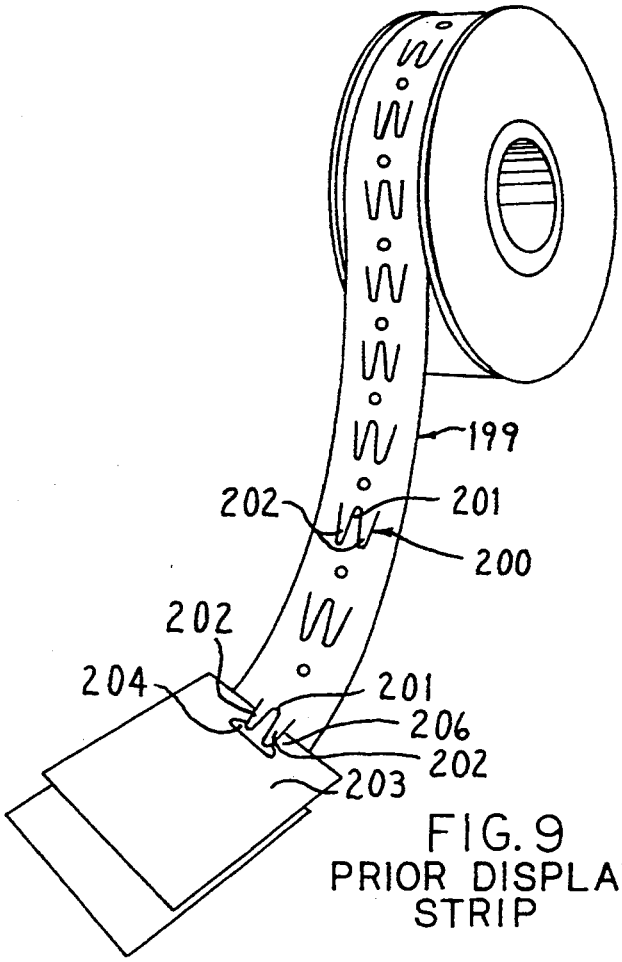
FIG. 9 is an isometric view of a prior display strip.

Referring to FIG. 9, a prior art support strip 199 is shown wherein an elongated W 200 comprises an upward central finger 201 and two stabilizing fingers 202 straddling the central finger, all defined by die cut lines in the strip. The central upward extending finger 201 is for holding a product 203 by insertion of the central upward finger 201 through an aperture 204 in the product 203. The two downward extending stabilizing fingers 202 also overlap the ribbon 206 of the material (or backer) of the product 203 to effect a secure holding of the product to the strip 199. However, the prior art strip is difficult to load with automated machinery because of the need to simultaneously displace the fingers 201 and 202 so that the ribbon 206 can enter the space therebetween.

The first strip 1 and second strip 10 of the display strip, hang tab combination of the invention can be made out of other elastically flexible materials such as cardboard, heavy weight paper or other synthetic or natural material. The thickness of the elastically flexible material should be selected depending on the weight of the product to be attached to the second strip. A heavier material will be required for heavier products and a lighter material will be sufficient for lighter products.

The bonding section 13 of the second strip can be mounted to a product by any suitable bonding means such as an adhesive or other mechanical cooperation between the second strip and the product.

As seen in FIGS. 1–5, 7A and 7B, the support member and flap members are generally of an elliptical shape. At least one of the first strip or the second strip should have an elliptically shaped tongue for locking engagement with the other strip. The other of the two strips should have either an elliptically shaped tongue or a circular aperture or hole with respective widest most widths less than the widest most width of the tongue on the other strip. The elliptical shape of at least one tongue makes the locking feature with another tongue or circular aperture inherent. The elliptical shape also allows for automatic product attachment to the display strip because only one tongue needs to be moved for attachment. This is an improvement over the prior art elongated W shape locking feature shown in FIG. 9 which creates difficulty in automatic attachment of products.

As described above, the display strip comprises a single vertical row of a plurality of alternating hanging sections and supporting sections with a hanging section being oriented above each supporting section. The display strip can be a single vertical row or multiple vertical rows of alternating hanging and supporting sections. Multiple vertical rows on the same strip permits mounting both horizontally and vertically many products.

In this type of mounting arrangement, a product or many products bonded to a second strip 10 (hang tab) may be manually or automatically loaded on the first strip 1 (display strip) for display because only one tongue has to be moved per loading of one product rather than three tongues in the prior W-shaped display strip.

In applying the invention, and in those instances where it is desired by a manufacturer to preload a plurality of products onto a display strip, the preload can be performed automatically and placed into shipping cartons for shipment to a store. The manner by which the product is mounted onto the display strip renders the securement secure for transit. After the display strips with products preloaded thereon is in the store, the store personnel need only remove the display strips (loaded with products) and hang them wherever deemed appropriate. The invention enables the foregoing to be accomplished.

Although particular embodiments of the invention have been described, it would be within the skill of the art to make modifications therein and still fall within the scope of the present invention.

The embodiments of the invention in which an exclusive property or privilege is claimed are defined as follows:

1. A display strip and hang tab combination comprising:

a first strip of elastically flexible material having a hanging section and a supporting section, said hanging section being positioned above said supporting section and comprising a means for hanging said first strip, said supporting section comprising a first half of a locking engagement;

a second strip of elastically flexible material comprising a first portion and a second portion, said first portion comprising a bonding section at which a product to be supported is attached thereto, said second portion comprising a second half of said locking engagement;

said locking engagement comprising a tongue on one of said first and second strips and an aperture on the other of said first and second strips, wherein said tongue is complimentary in shape and size to said aperture such that said tongue is lockingly engaged in said aperture, wherein said tongue is normally flat and has a widest most width adjacent a distal end of said tongue and a narrowest width intermediate said distal end of said tongue and a base of said tongue joining said tongue to said one of said first and second strips, said tongue being curled along a longitudinal of said tongue so that said widest most width is reduced to a dimension less than a widest most dimension of said aperture so that said tongue can pass through said aperture, an uncurling of said tongue to said normally flat condition thereof effecting said locking engagement.

2. The combination of claim 1 wherein said tongue is elliptically shaped.

3. The combination of claim 1, wherein said aperture is a generally round through hole.

4. The combination of claim 1 wherein said first half of said locking engagement is said tongue and said second half of said locking engagement is said aperture defined by cut lines in said second strip.

5. The combination of claim 1, wherein said aperture is an arcuate through slit.

6. The combination of claim 1 wherein said first half of said locking engagement is said aperture defined by cut lines in said first strip and said second half of said locking engagement is said tongue.

7. The combination of claim 1 further including a product attached to said bonding section of said second strip.

8. A display strip and hang tab combination comprising:

a first strip of flexible material having a hanging section and a supporting section, said hanging section being positioned above said supporting section and comprising a means for hanging said first strip, said supporting section comprising a first tongue defined by cut lines and a bend area in said supporting section;

said first tongue comprising a widest most width and a narrowest most width below said widest most width and being pivotable between an initial position wherein said first tongue lies in a plane containing said supporting section and a second position wherein said first tongue projects from said bend area out of the plane containing said supporting section and creates an opening therein;

a second strip of flexible material comprising a first portion and a second portion, said first portion comprising a bonding section at which a product to be supported is attached thereto;

said second portion having provided therein cut lines and a second bend area defining a second tongue, said second tongue comprising a widest most width and a narrowest most width below said widest most width and being pivotable between an initial position wherein said second tongue lies in a plane containing said second portion and a second position wherein said second tongue projects from said second bend area out of said plane containing said second portion and creates an opening therein;

each of said first tongue and said second tongue being complimentary in shape and size such that said first strip is lockingly engaged to said second strip by reception of said first tongue deformed of said first strip through said opening created in said second portion of said second strip whereby said second portion opposes the removal of said first tongue undeformed or by insertion of said second tongue deformed of said second strip through said opening created in said supporting section of said first strip whereby said supporting section opposes the removal of said second tongue undeformed.

9. The combination of claim 8, wherein said first tongue and said second tongue are elliptically shaped.

10. The combination of claim 8 wherein said first tongue is lockingly engageable with said second portion of said second strip by insertion of said first tongue deformed through said opening created in said second portion, wherein said second portion opposes the removal of said first tongue undeformed.

11. The combination of claim 10 wherein the narrowest most width of said first tongue is equal to or slightly less than the widest most width of said second tongue.

12. The combination of claim 8 wherein said second tongue is lockingly engageable with said support section of said first strip by insertion of said second tongue deformed through said opening created in said supporting section, whereby said supporting section opposes the removal of said second tongue undeformed.

13. The combination of claim 12 wherein the narrowest most width of said second tongue is equal to or slightly less than the widest most width of said first tongue.

14. The combination of claim 8 wherein said bonding section comprises an adhesive.

15. The combination of claim 8, wherein the first strip comprises vertical row of alternating hanging sections and supporting sections.

16. The combination of claim 8, wherein the first strip comprises a plurality of vertical rows of alternating hanging sections and supporting sections.

17. A locking display strip and hang tab combination comprising:

a first strip of flexible material having a hanging section and a supporting section, said hanging section being positioned above said supporting section and comprising means for hanging said first strip, said supporting section comprising a first tongue defined by cut lines and a bend area;

said first tongue comprising a widest most width and a narrowest most width and being pivotable between an initial position wherein said first tongue lies in a plane containing said supporting section and a second position wherein said first tongue projects from said bend area out of the plane containing said supporting section and creates an opening therein, said first tongue being deformable in said second position;

a second strip of flexible material comprising a first portion and a second portion, said first portion comprising a bonding section at which a product to be supported is attached thereto, said second portion having provided therein cut lines and a second bend area defining a second tongue;

said second tongue comprising a widest most width and a narrowest most width below said widest most width, said widest most width of said second tongue being equal to or slightly greater than said narrowest most width of said first tongue, said second tongue being pivotable between an initial position wherein said second tongue lies in a plane containing said second portion and a second position wherein said second tongue projects from said second bend area out of said plane containing said second portion and creates an opening therein, said opening and said second tongue being complementary in shape and size to said first tongue such that said first strip is lockingly engaged to said second strip by reception of a first tongue deformed in said opening of said second portion whereby said second portion opposes the removal of a first tongue undeformed therefrom.

18. A display strip and hang tab combination comprising:

a first strip of flexible material having a hanging section and a supporting section, said hanging section being positioned above said supporting section and comprising means for hanging said first strip, said supporting section comprising a first tongue defined by cut lines and a bend area;

said first tongue comprising a widest most width and a narrowest most width and being pivotable between an initial position wherein said first tongue lies in a plane containing said supporting section and a second position wherein said first tongue projects from said bend area out of the plane containing said supporting section and creates an opening therein;

a second strip of flexible material comprising a first portion and a second portion, said first portion comprising a bonding section at which a product to be supported is attached thereto, said second portion having provided therein cut lines and a second bend area defining a second tongue;

said second tongue comprising a widest most width and a narrowest most width below said widest most width, said narrowest most width of said second tongue being equal to or slightly less than said widest most width of said first tongue, said second tongue being pivotable between an initial position wherein said second tongue lies in a plane containing said second portion and a second position wherein said second tongue projects from said second bend area out of said plane containing said second portion, said second tongue being deformable in said second position and complimentary in shape and size to said opening created in said supporting section for engagement; and said opening created in said supporting section and said first tongue receive a second tongue deformed therein and oppose the removal of a second tongue undeformed therefrom.

19. A display strip, hang tab and product combination comprising:

a product;

a first strip of flexible material having a hanging section and a supporting section, said hanging section being positioned above said supporting section and comprising means for hanging said first strip, said supporting section comprising a first tongue defined by cut lines and a bend area in said supporting section;

said first tongue comprising a widest most width and a narrowest most width below said widest most width and being pivotable between an initial position wherein said first tongue lies in a plane containing said supporting section and a second position wherein said first tongue projects from said bend area out of the plane containing said supporting section and creates an opening therein;

and a second strip of flexible material comprising a first portion and a second portion, said first portion comprising a bonding section at which said product is attached thereto, said second portion having provided therein cut lines and a second bend area defining a second tongue, said second tongue comprising a widest most width and a narrowest most width below said widest most width and being pivotable between an initial position wherein said second tongue lies in a plane containing said second portion and a second position wherein said second tongue projects from said second bend area out of said plane containing said second portion and creates an opening therein;

each of said first tongue and said second tongue being complimentary in shape and size such that said first strip is lockingly engaged to said second strip by reception of said first tongue deformed of said first strip through said opening created in said second portion of said second strip whereby said second portion opposes the removal of said first tongue undeformed, or by insertion of said second tongue deformed of said second strip through said opening created in said supporting section of said first strip whereby said supporting section opposes the removal of said second tongue undeformed.

20. The combination of claim 19 wherein said first tongue is lockingly engageable with said second portion of said second strip by insertion of said first tongue deformed through said opening created in said second portion, wherein said second portion opposes the removal of said first tongue undeformed.

21. The combination of claim 20 wherein the narrowest most width of said first tongue is equal to or slightly less than the widest most width of said second tongue.

22. The combination of claim 19 wherein said second tongue is lockingly engageable with said supporting section of said first strip by insertion of said second tongue deformed through said opening created in said supporting section, whereby said supporting section opposes the removal of Said second tongue undeformed.

23. The combination of claim 22 wherein the narrowest most width of said second tongue is equal to or slightly less than the widest most width of said first tongue.

24. The combination of claim 19, wherein said first tongue and said second tongue are elliptically shaped.

25. The combination of claim 19 wherein said bonding section comprises an adhesive.

26. The combination of claim 19 wherein said product comprises a top wall, a bottom wall, a longitudinal surface joining the top and bottom walls and a center of gravity between the top wall and the bottom wall.

27. The combination of claim 19 wherein said product comprises a bag.

28. A display strip and hang tab combination comprising:

a first strip of elastically flexible material having a hanging section and a supporting section, said hanging section being positioned above said supporting section and comprising a means for hanging said first strip, said supporting section comprising a first half of a locking engagement;

a second material having means thereon defining a second half of said locking engagement;

said locking engagement comprising a tongue on one of said first and second strips and an aperture on the other of said first and second strips, said tongue being complimentary in shape and size to said aperture such that said tongue is lockingly engaged in said aperture, said aperture including means for opposing the removal of said tongue and wherein when said first half of said locking engagement is said tongue, said second half of said locking engagement is said aperture, and when said first half of said locking engagement is said aperture, said second half of said locking engagement is said tongue, said tongue comprising a widest most width at a distal end thereof and a narrowest most width intermediate said widest most width and a base of said tongue joining said tongue to said one of said first and second strips and being deformable into a U-shape and being pivotable at said base, said aperture being defined by through cut lines having a widest most width less than the widest most width of said tongue to thereby prevent an undeformed tongue projecting therethrough from being withdrawn therefrom to define said means for opposing the removal of said tongue from said aperture.

29. The combination of claim 28, wherein said aperture is a generally round through hole.

30. The combination of claim 28, wherein said aperture is an arcuate through slit.

* * * * *